US006352027B1

(12) United States Patent
Wadlinger

(10) Patent No.: US 6,352,027 B1
(45) Date of Patent: Mar. 5, 2002

(54) PRINTING MACHINE WITH A FINGER PROTECTOR

(75) Inventor: Ralf Wadlinger, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/419,693

(22) Filed: Oct. 14, 1999

(30) Foreign Application Priority Data

Oct. 14, 1998 (DE) ..... 198 47 290

(51) Int. Cl.[7] ..... B41F 5/00
(52) U.S. Cl. ..... 101/216; 101/483
(58) Field of Search ..... 101/216, 375, 101/212, 368, 232, 217, 218, 483

(56) References Cited

U.S. PATENT DOCUMENTS

| | | | | | |
|---|---|---|---|---|---|
| 3,593,662 | A | * | 7/1971 | Gates | 101/218 |
| 3,889,596 | A | * | 6/1975 | Thomas et al. | 101/154 |
| 4,295,421 | A | * | 10/1981 | Abendroth et al. | 101/216 |
| 4,362,098 | A | * | 12/1982 | Stelling et al. | 101/219 |
| 4,454,812 | A | * | 6/1984 | Johne et al. | 101/212 |
| 4,870,900 | A | * | 10/1989 | Robertson | 101/216 |
| 4,934,305 | A | | 6/1990 | Koehler et al. | 118/46 |
| 5,537,922 | A | * | 7/1996 | Becker | 101/216 |
| 5,787,810 | A | * | 8/1998 | Stephan | 101/232 |
| 5,967,038 | A | * | 10/1999 | Feller | 101/218 |

FOREIGN PATENT DOCUMENTS

| | | | | |
|---|---|---|---|---|
| CA | 1129245 | * | 8/1982 | 101/232 |
| DE | 43 18 777 C2 | | 4/1996 | |
| DE | 42 04 142 C2 | | 1/1997 | |
| DE | 196 03 666 C2 | | 6/1998 | |
| DE | 197 19 624 C1 | | 6/1998 | |
| DE | 197 05 218 A1 | | 8/1998 | |
| GB | 1 406 636 | | 9/1975 | |

* cited by examiner

*Primary Examiner*—John S. Hilten
*Assistant Examiner*—Anthony H. Nguyen
(74) *Attorney, Agent, or Firm*—Herbert L. Lerner; Laurence A. Greenberg; Werner H. Stemer

(57) ABSTRACT

An improvement in a printing machine includes a finger protector formed as a blast tube and arranged in a region of a wedgelike cylinder nip formed by an impression cylinder together with an adjustable cylinder, the adjustable cylinder being adjustable into a clearance position far removed from the impression cylinder; and a method of operating the printing machine.

14 Claims, 2 Drawing Sheets

PRINTING MACHINE WITH A FINGER PROTECTOR

BACKGROUND OF THE INVENTION

Field of the Invention

The invention relates to a printing machine with a finger protector and, more particularly, a finger protector that is formed as a blast tube.

Protective devices of this general type serve as protection for the hands in printing machines, and prevent the operator's hand from being pulled in between two cylinders if the operator should carelessly reach too far into the cylinder nip during cleaning or maintenance work.

German Patent 44 17 054, corresponding to U.S. Pat. No. 5,537,922, describes, by way of example, a proofing device in the printing unit of a printing machine. This multifunctional proofing device serves mainly as a guide element for printing plates and additionally as a finger protection and blasting device. The blasting or blowing function makes it possible to supply drying air to the cylinder surface of a rubber blanket cylinder at the end of a washing operation. The proofing device is arranged in a nip formed by a plate cylinder together with a rubber blanket cylinder, and therefore not in a nip formed by an impression cylinder together with an adjustable cylinder.

The published German Patent Document DE 43 18 777 C2 describes a device for assisting the guidance of sheets. As illustrated diagrammatically in this document, the blast tubes of this device do not extend over the entire cylinder width and have no finger protection function. On the contrary, the object upon which this device is based is to build up an air cushion between a sheet and a rubber blanket cylinder, on a printing unit that is not involved with printing and that has a nip between the rubber blanket cylinder and an impression cylinder. The device does not have an adjustable cylinder that is adjustable into a clearance position far removed from an impression cylinder. The build up of the air cushion is, of course, only possible when the clearance between the rubber blanket cylinder and the sheet-guiding impression cylinder is 2 millimeters, as specified, which is thus a very small clearance.

The published German Patent Document DE 690 22 419 T2, corresponding to U.S. Pat. No. 4,934,305, corresponding to the published European Patent Document EP 0 477 283 B1 describes a retractable coating device with a rubber blanket cylinder. The coating cylinder can be adjustable relative to an impression cylinder into an operating position for coating the printing-material sheet resting on the impression cylinder, into a cut-off position with a small clearance relative to the impression cylinder and into a position, designated as a second position, far removed from the impression cylinder and with good access to the coating cylinder for the purpose of maintenance or cleaning. There is no finger protector in this coating device.

The published German Patent Document DE 297 10252 U1 describes a guide arrangement for sheetlike printing material in a printing machine. The guide arrangement includes a guide tube that is preceded by a pivotably mounted pneumatic system and, for example, a blast tube extending over the entire width of a sheet guide cylinder. The guide plate can be coupled to a circuit-safeguarded protective device for protecting against hazardous locations in the region of the sheet guide cylinder. The guide arrangement includes, in addition to the guide plate described hereinabove, a further guide plate that is mounted so as to be pivotably movable and that is sensor-safeguarded which serves as a switching protective device if a person enters the region formed by the sheet guide cylinder. The two guide plates are assigned to sheet guide cylinders functioning as transfer drums between a printing unit and a varnishing unit. The transfer drums are not mounted so as to be capable of being thrown off or disengaged from one another, but, as is known, are mounted fixed in position location in the machine frame.

SUMMARY OF THE INVENTION

It is accordingly an object of the invention to provide a printing machine that is safeguarded against risks of injury, that can be operated in a maintenance-friendly manner and operates with a smear-free sheet run. It is a further object of the invention to provide a method for operating a sheet-fed printing machine.

With the foregoing and other objects in view, there is provided, in accordance with one aspect of the invention, in a printing machine, an improvement therein comprising a finger protector formed as a blast tube and arranged in a region of a wedgelike cylinder nip formed by an impression cylinder together with an adjustable cylinder, the adjustable cylinder being adjustable into a clearance position far removed from the impression cylinder.

In accordance with another feature of the invention, a minimum circumferential clearance of the cylinders relative to one another, when the adjustable cylinder is located in the far-removed clearance position, is equal to at least several centimeters and, in particular, several decimeters.

In accordance with a further feature of the invention, in a protective position protecting against entry into the cylinder nip, the finger protector is movably mounted and the position thereof is sensor-monitored.

In accordance with an added feature of the invention, the printing machine includes a sensor for monitoring the position of the finger protector, the sensor being responsive for stopping a drive for rotating the adjustable cylinder, when the finger protector is forced out of the protective position.

In accordance with an additional feature of the invention, the sensor is formed as an electric motor.

In accordance with yet another feature of the invention, the finger protector is forcible out of the protective position due to manual contact during cleaning of the adjustable cylinder.

In accordance with yet a further feature of the invention, the finger protector and the blast tube forming the finger protector, respectively, are able to be acted upon by blowing air and are functionable as a sheet guide element when the adjustable cylinder is adjusted to the far-removed clearance position.

In accordance with yet an added feature of the invention, the blast tube is connected to a compressed air source for supplying the blast tube with blast air having such a pressure level that jet pressure of blast air flowing out of blast orifices formed in the blast tube maintains a printing-material sheet, that is being transported past the finger protector by the impression cylinder, at a distance from the finger protector at least over most of the sheet length thereof.

In accordance with yet an additional feature of the invention, the blast air orifices formed in the blast tube are oriented, in the angular position thereof, in a manner that, due to the jet direction of the blast air jets impinging on the printing-material sheet, the sheet that is transported past the finger protector by the impression cylinder is maintained at a distance from the finger protector at least over most of the sheet length thereof.

In accordance with still another feature of the invention, the impression cylinder and the adjustable cylinder are components of a unit of the printing machine, the unit being arranged downline of at least one of a printing and a coating unit of the printing machine, as viewed in the sheet transport direction, and being capable of being placed selectively into an activated and into an inactivated state, the adjustable cylinder, in the inactivated state, being adjusted to the far-removed clearance position, and the blast tube, in the inactivated state, being acted upon by blast air.

In accordance with still a further feature of the invention, the unit is one of a printing, a coating and a finishing unit, respectively.

In accordance with still an added feature of the invention, the adjustable cylinder is adjustable into a throw-on position wherein it has operative contact with one of the impression cylinder and the printing-material sheet resting thereon, respectively, the adjustable cylinder being one of a cylinder for printing the printing-material sheet in the throw-on position, a cylinder for coating the printing-material sheet, and a cylinder for processing the printing-material sheet.

In accordance with still an additional feature of the invention, the printing is with at least one of impressions and numberings, respectively, the coating is with varnish, and the processing is by at least one of perforating, scoring, embossing, cutting, punching, smoothening, calendering and dedusting, respectively.

In accordance with a concomitant aspect of the invention, there is provided a method for operating a sheet-fed printing machine, which comprises disposing at least one of a printing unit and a coating unit, respectively, and a further unit inline with and downline of the latter; in one operating mode of the sheet-fed printing machine, respectively printing and coating a printing-material sheet in the at least one printing unit and coating unit, that is in an active state; and thereafter, in an in-line process, passing by the further unit, that is in an inactive state; by an impression cylinder of the further unit, transporting the printing-material sheet; adjusting an adjustable cylinder into a clearance position far removed from the impression cylinder of the further unit; and applying blast air to the finger protector of the further unit from smearing the, respectively, freshly printed and coated printing-material sheet transported past the finger protector.

The printing machine with a finger protector constructed as a blast tube is distinguished in that the finger protector is arranged in the region of a wedgelike cylinder nip formed by an impression cylinder together with an adjustable cylinder, the adjustable cylinder being adjustable to a clearance position far removed from the impression cylinder.

The finger protector reliably protects the operator from any injuries, for example, during the manual cleaning of the adjustable cylinder. The adjustable cylinder is easily accessible in the far-removed clearance position for maintenance purposes, and, for example, a varnishing or printing form located on the adjustable cylinder can be exchanged, without any need for reaching deeply into the machine or similar difficulties. Constructing the finger protector as a blast tube ensures a smear-free run of the printing-material sheet past the finger protector.

An embodiment that advantageously develops the printing machine according to the invention is distinguished in that, with the adjustable cylinder located in the clearance position, a minimum circumferential clearance of the adjustable cylinder relative to the impression cylinder amounts to at least several centimeters and, in particular, several decimeters.

The clearance between the cylinders may amount, for example, to at least 20 centimeters.

A further embodiment is distinguished in that, in a protective position protecting against entry into the cylinder nip, the finger protector is movably mounted, and the position thereof is sensor-monitored.

A further embodiment is distinguished in that the position of the finger protector is monitored by a sensor formed, in particular, as an electric switch which responds and stops a drive rotating the adjustable cylinder when the finger protector is forced out of the protective position, for example, due to manual contact when the adjustable cylinder is being cleaned.

A further embodiment is distinguished in that the finger protector or the blast tube forming the latter can be acted upon by blast air, and functions as a sheet guide element when the adjustable cylinder is adjusted to the far-removed clearance position.

A further embodiment is distinguished in that the blast tube is connected to a compressed air source and can be supplied by the latter with blast air having such a pressure level that the jet pressure of the blast air flowing out of blast orifices of the blast tube keeps a printing-material sheet, that is transported past the finger protector by the impression cylinder, at a distance from the finger protector at least over most of the sheet length.

For example, as a result of the action of the blast air, a printing-material sheet is kept at a distance from the finger protector over the length of a freshly printed-on printed image facing the finger protector, and it is perfectly possible for a narrow nonprinted marginal strip usually present at the trailing edge of the printing-material sheet to abut against the finger protector, without causing any problems.

A further embodiment is distinguished in that the blast air orifices of the blast tube are oriented, in the angular position thereof, in such a manner that, due to the jet direction of the blowing air jets impinging on the printing-material sheet, the sheet, that is transported past the finger protector by the impression cylinder, is kept at a distance from the finger protector at least over most of the sheet length.

By rotation of the entire blast tube or by an individual setting of blast air nozzles of the blast tube, the orientation of the blast air orifices can be adapted to the printing-material sheet which, for example, is somewhat stiffer in one case and somewhat less stiff in another case. The orientation of the blast air orifices may be such that a central jet of the respective blast-air orifice impinges on the printing-material sheet substantially perpendicularly or obliquely opposite to the sheet transport direction, i.e., at an acute angle to the printing-material surface.

A further embodiment is distinguished in that the impression cylinder and the adjustable cylinder are components of a unit, in particular a printing, a coating or a finishing unit of the printing machine, the unit being arranged downline of at least one printing or one coating unit of the printing machine as viewed in the sheet transport direction, and being capable of being placed selectively into an activated and into an inactivated state, the adjustable cylinder, in the inactivated state, being adjusted to the far-removed clearance position, and the blast tube being acted upon by blast or blowing air.

A further embodiment is distinguished in that the adjustable cylinder can be placed into a throw-on position having operative contact with the impression cylinder or with the printing-material sheet resting on the latter, and is a cylinder for printing, for coating or for processing the printing-material sheet in the throw-on position.

For example, the adjustable cylinder may be a printing form cylinder for the printing of impressions or numberings, or an applicator cylinder for coating the printing-material sheet with a varnish, or a tool-fitted cylinder for perforating, scoring, embossing, cutting, punching, smoothing, calendering or dedusting the printing-material sheet.

In the method according to the invention for operating a sheet-fed printing machine that is constructed, in particular, according to one of the embodiments described hereinabove and that comprises at least one printing unit or one coating unit and a further unit located inline with and downline of the latter, in one operating mode of the sheet-fed printing machine, a printing-material sheet is printed or coated in the printing unit or coating unit, active in this case, and subsequently, in the in-line process passes the further unit, inactive in this case, an impression cylinder of the further unit transporting the printing-material sheet, an adjustable cylinder being adjusted into a clearance position far removed from the impression cylinder of the further unit, and a finger protector of the further unit being protected, by being loaded with blast air, from smearing the freshly printed or coated printing-material sheet transported past the finger protector.

Other features which are considered as characteristic for the invention are set forth in the appended claims.

Although the invention is illustrated and described herein as embodied in a printing machine with a finger protector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
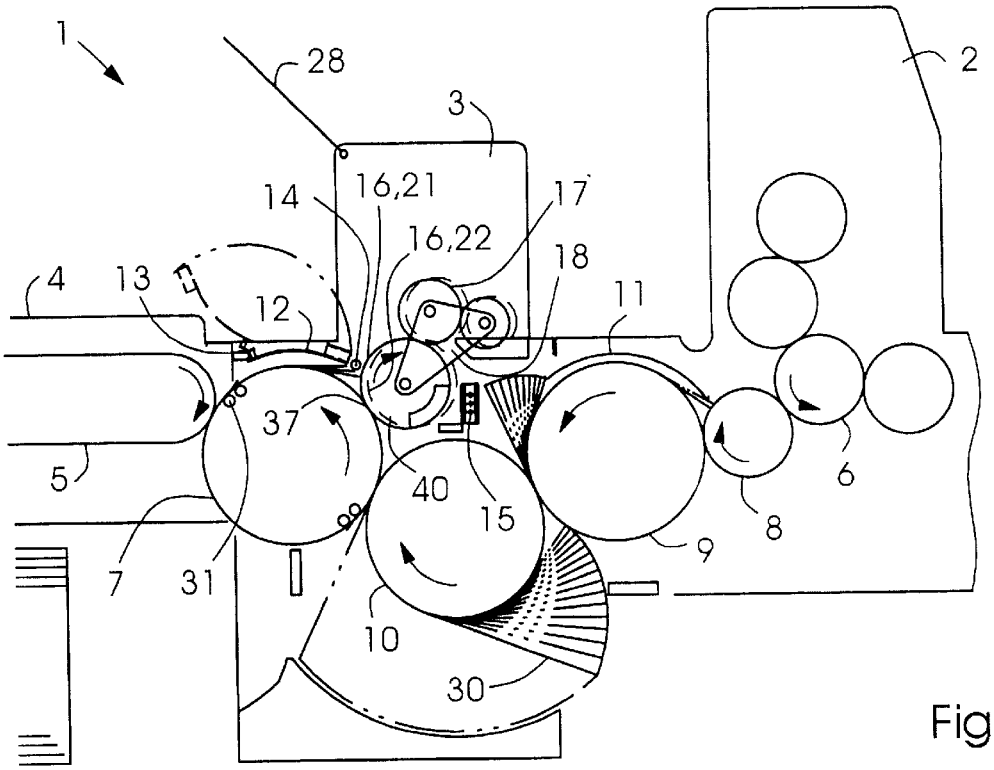
FIG. 1 is a fragmentary diagrammatic side elevational view of a rotary printing machine for printing printing-material sheets, having a varnishing unit actively participating in the in-line process and provided with the finger protector according to the invention.

Referring now to the drawings and, first, particularly to FIG. 1 thereof, there is illustrated therein a printing machine 1 with a printing unit 2 and, for example, a varnishing unit 3.

Figure 2:
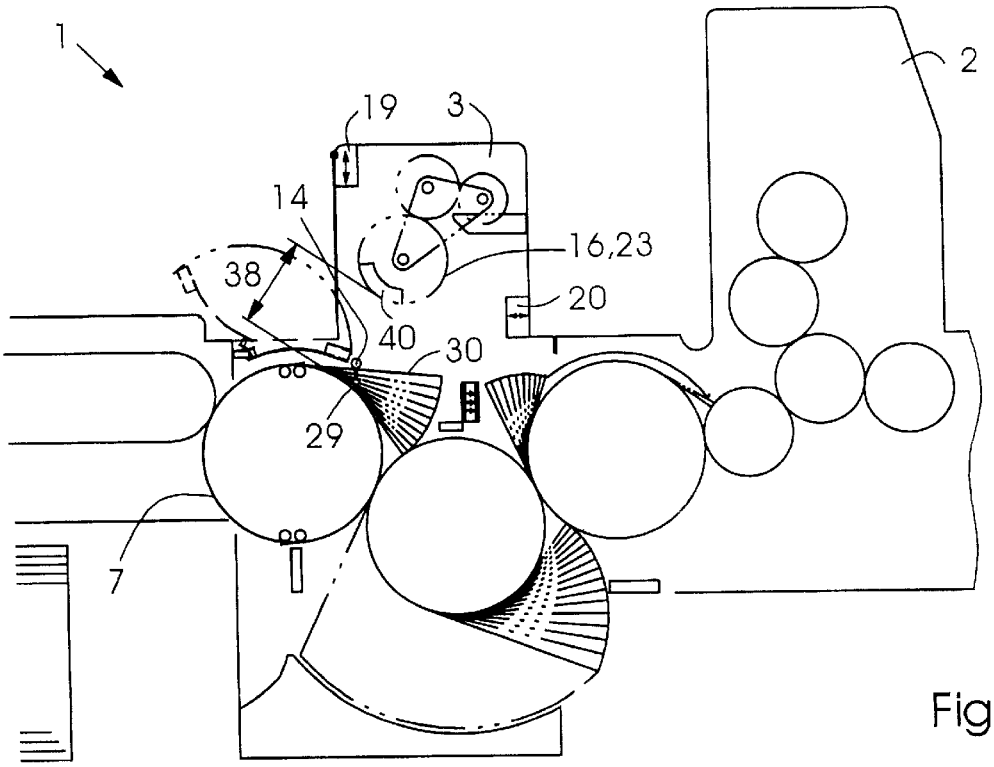
FIG. 2 is a view like that of FIG. 1 showing the printing machine with the varnishing unit inactive and not participating in the in-line process.

The printing machine 1, in the form of a rotary printing machine, includes, for multicolor printing of printing-material sheets 30, a plurality of printing units succeeding one another in an in-line arrangement, only the last printing unit 2 of which, as viewed in the sheet transport direction, being illustrated in the figure. The varnishing unit 3 is arranged between the printing unit 2 and a sheet delivery 4 having a chain gripper 5. The printing unit 2 and also the non-illustrated further printing units are constructed as offset printing units and, respectively, have an impression cylinder 6. Sheet transfer drums 8, 9 and 10 transport the printing-material sheets 30, held by gripper closure, from the impression cylinder 6 of the printing unit 2 to the impression cylinder 7 of the varnishing unit 3. In relation to the single-sized circumference of the impression cylinder 6 for carrying a single sheet 30 of the printing material, the sheet transfer drums 9 and 10 and the impression cylinder 7 have a multi-sized circumference for the simultaneous guidance of a plurality of printing-material sheets 30. The printing-material sheet 30 guided on the sheet transfer drum 9 is first held thereon by a sheet guide element 11 arranged above the drum 9 and is subsequently forced by the blower 15 onto the sheet transfer drum 9 and away from the sheet transfer drum 10. The blower 15 may be formed of a row of fans extending perpendicularly to the plane of the drawing. The sheet transfer drum 10 guides the printing-material sheet 30, held at the leading edge thereof in the grippers of the drum 10, so that the sheet 30 hangs down virtually freely. In this regard, the printing-material sheet 30 hangs from the sheet transfer drum 10 below the latter without any element for holding the trailing edge of the printing-material sheet 30 on the sheet transfer drum 10 or for pressing it against the latter. The impression cylinder 7 has a sheet guide element 12 assigned thereto that is pivotable about a joint 13 and formed as a hinged plate. The sheet guide element 12 is arranged above the impression cylinder 7 and is curved equidistantly around the impression cylinder 7 and concentrically to the latter, respectively. The sheet guide element 12 is of unipartite construction and serves as a flap which, in an opened position illustrated by broken lines, allows access into the interior of the printing machine and, in a closed position illustrated by solid lines, screens off such access. With the sheet guide element 12 open, the inner side thereof and the impression cylinder 7 are easily accessible for cleaning purposes. A coating cylinder 16 is accessible for cleaning by opening a flap 28 of the housing of the varnishing unit 3. A cylinder 16 is mounted rotatably in a carrier 18. Further mounted in the carrier 18 is a supply device for a metered supply of varnish to the cylinder 16. This supply device may be formed, for example, of a dipping roller for scooping the varnish from a varnish trough, and of a metering roller for transferring the varnish from the dipping roller onto the cylinder 16. Also, when, instead of the illustrated varnishing unit 3, a printing unit 3 is substituted and the coating cylinder 16 is replaced by a printing cylinder, and furthermore when the unit 3 is a finishing unit and the coating cylinder 16 is a processing cylinder, the respective processing cylinder 16 may be mounted rotatably in the carrier 18 so as to be connected together with one or more further cylinders. Although the following description is based on the example of the illustrated coating or varnishing unit 3, the described constructions may be readily transferred to a printing or finishing unit, in which cases the cylinder 16 does not coat the printing-material sheet guided on the impression cylinder 7, but, instead, prints it or processes it. The cylinder 16 forms, together with the carrier 18 and the supply device 17, a unit capable of being adjusted into the active position 21, into the neutral position 22 and into the passive position 23 (FIG. 2). When the adjustable unit is thus adjusted into the position illustrated by broken and dotted lines in FIG. 1, in which the cylinder 16 is in operative contact with the impression cylinder 7, varnish is applied by the cylinder 16 to the printing-material sheet 30 resting on the impression cylinder 7. Through the intermediary of an adjusting device 20 indicated only diagrammatically in FIG. 2, the cylinder 16 can be adjusted in a first direction of movement, for example, approximately horizontally, selectively into the active position 21 and into the neutral position 22. In the neutral position 22, which would be designated as a print cut-off in the case of a cylinder 16 formed as a printing cylinder, there is a small circumferential clearance of, for example, 2 millimeters between the cylinders 7 and 16. Through the intermediary of a further adjusting device 19 (FIG. 2), the cylinder 16 or the complete unit 16 to 18 can be adjusted in a second direction of movement, for example, approximately vertically, selectively into the neutral position 22 or into the passive position 23. When the cylinder 16 is adjusted into the passive position 23 (FIG. 2), the minimum outer surface clearance 38 between the cylinders 7 and 16 amounts, for example, to 30 centimeters. As viewed in the sheet transport direction of the impression cylinder 7, a finger protector 14 is arranged axially parallel to the cylinders 7 and 16 in the region of a sheet exit nip 37 formed by the cylinders 7 and 16. The finger protector 14, in the form of a round bar, has an outer clearance of approximately 6 millimeters relative to the outer circumferential surface of the cylinder 16 when the latter is in the neutral position 22. When the cylinder 16 is cleaned in the circumferential region thereof located above the finger protector 14, the operator's hand or finger therefore cannot be pulled through between the finger protector 14 and the cylinder 16. This hazard prevented by the finger protector 14 is caused by the fact that the cleaning of the cylinder 16 involves a change in direction of rotation. Due to the change in direction of rotation, the cylinders 7 and 16 rotate opposite to the respective directions of rotation illustrated in FIG. 1. The rotations of the cylinders 7 and 16 are driven by a drive 33, illustrated in FIG. 3, which is a main drive of the printing machine 1, the main drive driving all the printing units 2 and the varnishing unit 3. When in positions 21 and 22, two gearwheels arranged, respectively, coaxially with the cylinders 7 and 16 and drive-connected to the respective cylinders 7 and 16, mesh with one another, so that the cylinder 16 can be driven in coordination with the cylinder 7 via a gearwheel train by the drive 33 driving the cylinder 7. If there is a pitlike cylinder gap or channel 40 extending in the axially parallel direction, sensor safeguarding of the finger protector 14 is particularly advantageous. The cylinder gap 40 may receive, for example, a holding and tensioning device for fastening a printing plate or a tool plate on the cylinder 16, if the cylinder 16 is a component of a corresponding unit 3. In the case of the illustrated varnishing unit 3, the cylinder gap 40 serves for tension-mounting a varnishing form or a varnishing blanket on the coating cylinder 16. When the cylinder gap 40 is located approximately opposite the finger protector 14 and faces the latter, the clearance, first specified above as about 6 millimeters, between the finger protector 14 and the cylinder 16 is greater than the aforementioned value in the corresponding circumferential region of the cylinder 16, because of the depth of the cylinder gap 40. In this case, there may be the additional hazard of the operator reaching past the finger protector 14 into the cylinder gap 40. In many cases, there is no need for any special precautions in this regard, for example, the sensor safeguarding of the finger protector 14. Such a situation occurs, for example, when, in order to clean the cylinder 16 located in the neutral position 22, in this case, the latter is rotated by the drive 33 (FIG. 3) once in the clockwise direction and once in the counterclockwise direction, in each case over less than one complete revolution, at crawling speed, during rotation every part of the outer surface located outside the cylinder gap 40 being easily accessible, but the cylinder gap 40 never coming opposite the finger protector 14. Nevertheless, even in cases of this type, sensor safeguarding of the finger protector 14 is highly advantageous, because the latter reacts by triggering a signal, for example, even when very thin articles, for example cleaning rags; are pulled into the cylinder nip 37. The sheet guide element 12 terminates directly at the finger protector 14 and covers a less critical region of the cylinder nip 37.

FIG. 2 illustrates the printing machine 1 in an operating mode wherein the printing-material sheets 30 are printed in four colors by the printing unit 2 and three other non-illustrated printing units, which precede the printing unit 2, as viewed in the sheet transport direction, and then pass the inactive varnishing unit 3, without any action of the cylinder 16 upon the printing-material sheets 30 transported by the impression cylinder 7. The impression cylinder 7 then transfers the printing-material sheets 30 to the chain gripper system 5, by which they are deposited upon a sheet pile. With regard to the illustrated varnishing unit 3, there is therefore only a printing of the printing-material sheets 30, but no varnishing. In such an operating mode, it is necessary to ensure that the printing-material sheets 30, in the form, for example, of flexurally rigid cardboard, are conveyed through the printing machine and, in particular, through or past the varnishing unit 3, without having the printing images thereof smudged and without any smearing of the yet-fresh ink onto parts of these assemblies. The following measures are performed for this purpose: the cylinder 16 and the unit 16 to 18, respectively, are adjusted to the passive position 23 thereof, wherein the cylinder 16 is safe from being struck by the trailing end of the sheet springing away from the impression cylinder 7. The finger protector 14, mounted in a protective position fixedly relative to the machine frame or stand and constructed as a blast tube 14, is acted upon by excess pressure, and the blast or blowing air 29 flowing out of orifices formed in the wall of the blast tube 14 impinges upon the printing-material sheet 30 held in grippers 31 of the pressure cylinder 7, forces this sheet 30 away from the finger protector 14 and presses it onto the impression cylinder 7. Striking of the nonprinted marginal strip on the sheet end against the finger protector 14 is just as harmless as when this marginal strip brushes along the sheet guide elements 11, 12. If the blowing air jets are oriented appropriately relative to the impression cylinder 7 and to the printing-material sheet 30, and if the pressure exerted upon the printing-material sheet 30 by all of the blast or blowing air flowing out of the blast tube 14 is sufficiently high, smear-free guidance of the yet-fresh printed image past the finger protector 14 is ensured in a relatively simple manner. The blast tube 14 may, of course, also be acted upon by blowing air and blowing, respectively, when the cylinder 16 is in the active position 21 or the neutral position 22.

Figure 3:
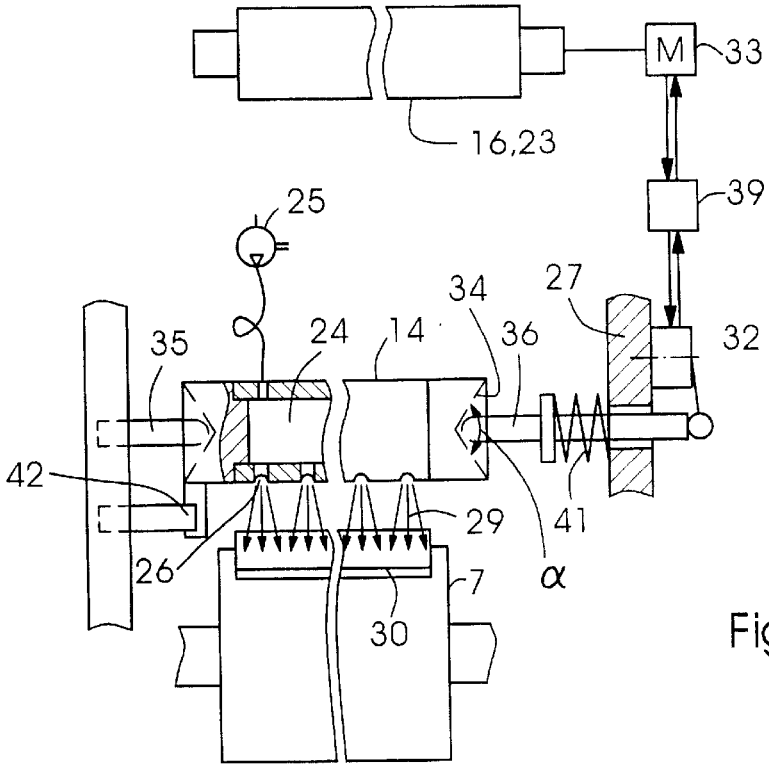
FIG. 3 is a greatly-enlarged fragmentary rear elevational view, partly in section, of FIG. 1, showing the finger protector of the varnishing unit in detail.

The finger protector 14 formed as a blast tube 14 is illustrated in detail in FIG. 3. The blast tube 14 has an axially extending row of blowing air orifices 26 directed onto the printing-material sheet 30. The finger protector 14, as viewed in the axial direction thereof, extends over the entire width of the cylinders 7 and 16. A blast or blowing air source 25, formed, for example, as a compressor, supplies blast or blowing air, that is under excess pressure, to an inner space 24 of the blast tube 14 via the hose line shown. The blowing air source 25 may also be connected to the blast tube 14 via an air-guiding rotary connection. In both cases, the blast tube 14 is rotatable about the longitudinal axis thereof, so that the blowing air orifices 26 can be oriented relative to the printing-material sheet 30 or to the impression cylinder 7 guiding the latter. The finger protector 14 is rotatably mounted in the frame or stand of the printing machine on both sides in side walls 27, is fixed by a counter-rotation device 42 in the rotary position thereof corresponding to the defined blowing direction and is held and clamped between two mandrels 35 and 36. At least one mandrel 36 is displaceably mounted in a sprung manner in the side wall 27. The mandrel 35 located opposite this mandrel 36 in an aligned coaxial position may be fastened in an unsprung manner to the side wall located on this machine side. The mandrels 35 and 36 possess rounded centering ends which are approximately in the form of a spherical cap and which, respectively, project into an inner-conical recess 34 at each end of the blast tube 14. The contact surface between the mandrel 35, 36 and the respective inner cone 34 is approximately annular. The finger protector 14 illustrated in FIG. 3 is in a preferred protective position axially parallel to the cylinders 7 and 16. Any positive deflection, caused by manual contact, for example, of the finger protector 14 out of the axial orientation or axial position thereof predetermined by clamping or by the protective position, results in a displacement of the mandrel 36 counter to the restoring force of the spring 41 and actuation of the electric switch 32 formed as a touch-contact switch. In this case, a circuit is opened or broken by a switch 32, with the result that an electronic control device 39 receives a signal and consequently stops a drive 33 of the cylinder 16, the drive 33 being formed as an electric motor, so that the cylinder 16 cannot pull the operator's hand reaching into the cylinder nip 37 any farther into the cylinder nip and injure it. The drive of the cylinder 16 by the electric motor 33 is reproduced highly diagrammatically in FIG. 3 and preferably takes place, as already described hereinabove, indirectly via a gearwheel train drive-connecting the cylinders 7 and 16. The position of the mandrel 36 may also be monitored by another suitable sensor differing from the aforedescribed sensor 32. The bearing points formed by the inner cones 34 and the rounded ends of the mandrels 35 and 36, 36 may, of course, also be designed in an interchange arrangement, in which case the finger protector 14 has rounded ends which engage in inner cones of displaceable parts functionally identical to the mandrel 35, 36 and assigned to the side walls 27. The angle $\alpha$ of the inner cone of the cones 34 is preferably an obtuse angle, so that when the finger protector 14 is shifted, a high-force component acts in the axial direction of displacement of the mandrel 36 due to the fact that the inner cone 34 acts in the manner of a thrust wedge. The spring 41 is dimensioned so that, after the cause of the deflection of the finger protector 14 has ceased, the restoring force of the spring 41 returns the finger protector device 14 into the original protective position thereof again, centers it and holds it safely in this position.

Figure 4:
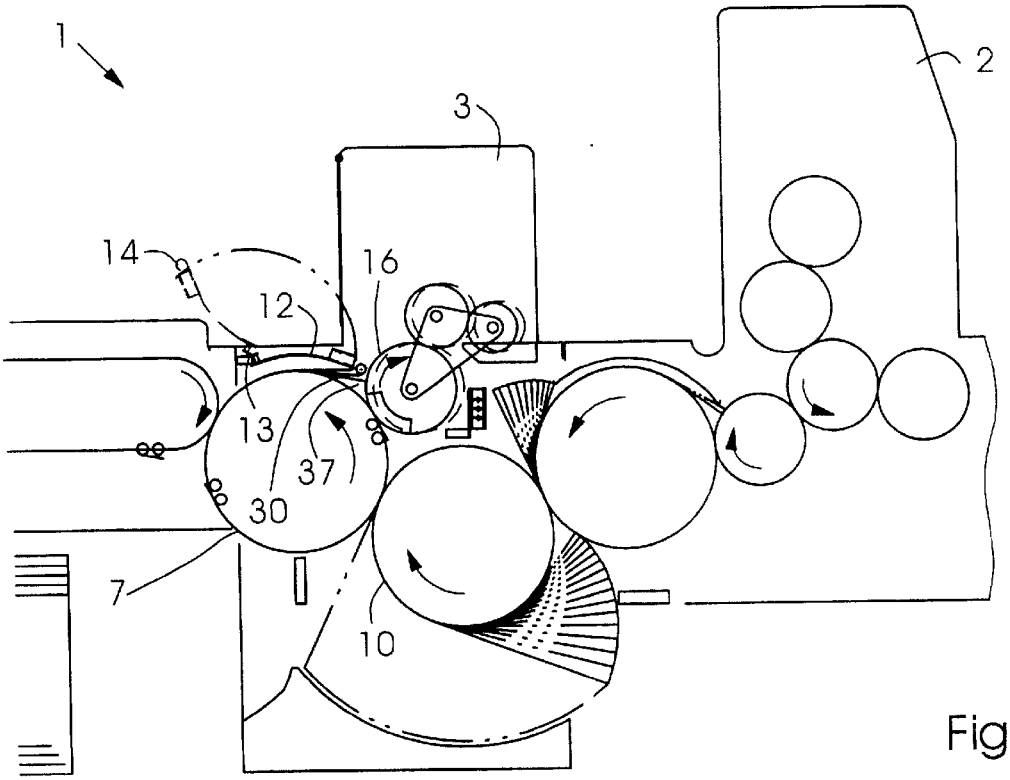
FIG. 4 is a view like that of FIG. 1 showing the printing machine with a different arrangement of the finger protector.

FIG. 4 illustrates another finger protector 12, 14 wherein the sheet guide element 12 arranged above the impression cylinder 7 serves as a finger guard that covers the cylinder nip 37 and carries the blast tube 14. The blast tube 14, formed at the leading edge of the sheet guide element 12, is pivotable together with the sheet guide element 12 and can be placed into the region of the cylinder nip 37. When the cylinder 16 is adjusted to the passive position 23 (FIG. 2) and, in this position, can no longer keep the printing-material sheet 30 away from the finger protector 12, 14 and hold the sheet 30 on the impression cylinder 7, this blast tube 14 too, like the blast tubes already described hereinabove, is acted upon by blast or blowing air and prevents the printing-material sheet 30 from striking, with the printed surface thereof, against the finger protector 12, 14 located in the region of the cylinder nip 37 and, simultaneously, prevents it from being smeared. Thus, in this printing machine too, the printed side of a printing-material sheet 30 can be kept away from the finger protector 14 without any contact and therefore so as to be free of smearing, the instant the sheet end is no longer supported on the sheet transfer drum 10 and the stretching sheet risks being smeared on the finger protector 14, a possibility that is prevented by applying blast or blowing air. In principle, the printing machine 1 illustrated in FIG. 4 corresponds to the printing machine 1 previously described hereinabove, with the exception of the arrangement of the finger protector 14 on the sheet guide element 12.

I claim:

1. A method for operating a sheet-fed printing machine, which comprises:

providing at least one of a printing unit and a coating unit;

disposing a further unit inline with and downstream of the at least one of the printing unit and the coating unit in the sheet transport direction, the further unit having a finger protector, an adjustable cylinder, and an impression cylinder;

in one operating mode of the sheet-fed printing machine, at least one of printing and coating a printing-material sheet in the then active at least one of the printing unit and the coating unit; and subsequently, in an in-line process, passing the print-material sheet by the then inactive further unit, transporting the printing-material sheet with the impression cylinder, adjusting the adjustable cylinder into a clearance position far removed from the impression cylinder, and protecting the finger protector from smearing the freshly at least one of printed and coated printing-material sheet transported past the finger protector by at least one of exposing, applying, and loading the finger protector with blast air.

2. In a printing machine, an improvement comprising:

an adjustable cylinder;

an impression cylinder together with said adjustable cylinder forming a wedgelike cylinder nip; and a finger protector including a blast tube disposed in a region of said wedgelike cylinder nip, said blast tube having blast orifices directing blast air exiting said orifices towards a printing-material sheet, said adjustable cylinder including structure for moving said cylinder between a clearance position far removed from said impression cylinder, and an operable position and said finger protector and said blast tube directing blast air as a printing-material sheet guide element when said adjustable cylinder is adjusted to said far-removed clearance position.

3. The printing machine according to claim 2, including a sensor, said finger protector being movably mountable into a protective position protecting against entry of fingers into said cylinder nip, and said sensor being disposed to monitor said protective position.

4. The printing machine according to claim 3, including a drive for rotating said adjustable cylinder, said sensor monitoring positions of said finger protector and stopping said drive when said finger protector is forced out of said protective position.

5. The printing machine according to claim 4, wherein said sensor is an electric switch.

6. The printing machine according to claim 4, wherein said finger protector is forcible out of said protective position due to manual contact during cleaning of said adjustable cylinder.

7. The printing machine according to claim 2, wherein said adjustable cylinder and said impression cylinder have a minimum circumferential clearance relative to one another equal to at least several centimeters when said adjustable cylinder is located in said far-removed clearance position.

8. The printing machine according to claim 7, wherein said minimum circumferential clearance is at least several decimeters.

9. The printing machine according to claim 2, including a compressed air source connected to said blast tube for supplying said blast tube with blast air having a pressure level that jet pressure of blast air flowing out of said blast orifices maintains a printing-material sheet being transported past said finger protector by said impression cylinder at a distance from said finger protector at least over most of the sheet length.

10. The printing machine according to claim 9, wherein said blast air orifices are oriented in an angular position such that, due to a jet direction of the blast air jets impinging on the sheet, the sheet transported past said finger protector by said impression cylinder is maintained at a distance from said finger protector at least over most of the sheet length.

11. The printing machine according to claim 9, wherein the printing machine has a unit and at least one of a printing unit and a coating unit, said impression cylinder and said adjustable cylinder are components of the unit, the unit is disposed downline of the at least one of the printing unit and the coating unit viewed in the sheet transport direction, and the unit is selectively placeable into an activated state and an inactivated state, said adjustable cylinder, in said inactivated state, being adjusted to said far-removed clearance position, and said blast tube, in said inactivated state, being acted upon by blast air.

12. The printing machine according to claim 11, wherein the unit is one of a printing, a coating and a finishing unit.

13. The printing machine according to claim 11, wherein said adjustable cylinder is adjustable into a throw-on position wherein said adjustable cylinder has operative contact with one of said impression cylinder and the printing-material sheet resting on said impression cylinder, and said adjustable cylinder is one of a cylinder for printing the printing-material sheet in said throw-on position, a cylinder for coating the printing-material sheets, and a cylinder for processing the printing-material sheet.

14. The printing machine according to claim 13, wherein said adjustable cylinder is one of a cylinder for printing the printing-material sheet in said throw-on position with at least one of impressions and numberings, a cylinder for coating the printing-material sheet with varnish, and a cylinder for processing the printing-material sheet by at least one of perforating, scoring, embossing, cutting, punching, smoothening, calendering, and dedusting.

* * * * *